United States Patent [19]

Chap

[11] Patent Number: 5,026,315

[45] Date of Patent: Jun. 25, 1991

[54] STUFFED WISHBONE TOY

[76] Inventor: Ramona R. Chap, 1201 E. Spring St., Tucson, Ariz. 85253

[21] Appl. No.: 541,068

[22] Filed: Jun. 20, 1990

[51] Int. Cl.[5] ..... A63H 3/02

[52] U.S. Cl. ..... 446/372; 446/396; 446/369; 5/436; D6/601

[58] Field of Search ..... 446/372, 369, 371, 396; 5/436, 437, 431, 434; D6/601, 597, 598, 599, 609

[56] References Cited

U.S. PATENT DOCUMENTS

| | | | |
|---|---|---|---|
| D. 254,891 | 5/1980 | Mills | D6/599 |
| D. 308,788 | 6/1990 | Boehm | D6/601 |
| 1,590,927 | 6/1926 | Duncan | 446/72 |
| 2,149,140 | 2/1939 | Rincones | 5/436 |
| 2,961,668 | 11/1960 | Hayes | 5/436 |
| 3,327,330 | 6/1967 | McCullough | 5/437 |
| 3,448,539 | 6/1969 | Hartpence | 446/370 |
| 4,060,863 | 12/1977 | Craig | 5/436 |
| 4,197,604 | 4/1980 | Nakamura | 5/437 |
| 4,540,378 | 9/1985 | Cusimano | 446/369 |

*Primary Examiner*—Richard J. Johnson

[57] ABSTRACT

The invention relates to a stuffed toy configured generally in the shape of the "wishbone" of a bird. The toy includes stuffed flexible elongated legs with a face at the apex of the wishbone. The legs are curved in an arc with a convex lower side facing in a downward direction in side view so that the toy may be rocked back and forth on a support surface. The toy may be used in a variety of ways, such as a pillow or cushion wherein the legs wrap around the neck of a user. Also, the legs may be twisted pretzel-like to simulate a leg crossing position.

3 Claims, 1 Drawing Sheet

STUFFED WISHBONE TOY

BACKGROUND AND SUMMARY OF THE INVENTION

The invention relates to a stuffed toy configured generally in the shape of the "wishbone" of a bird. The toy includes stuffed flexible elongated legs with a face at the apex of the wishbone. The legs are curved in an arc with a convex lower side facing in a downward direction in side view so that the toy may be rocked back and forth on a support surface.

The toy may be used in a variety of ways such as a pillow or cushion wherein the legs wrap around the neck of a user. Also, the legs may be twisted pretzel-like to simulate a leg-crossed position.

DETAILED DESCRIPTION OF A PREFERRED EMBODIMENT

Figure 1:
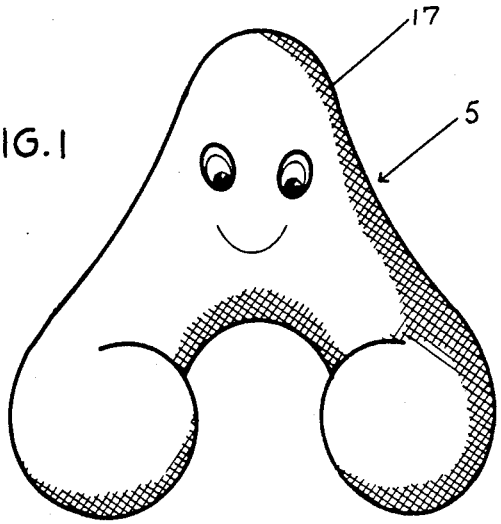
FIG. 1 is a front view of the wishbone toy.
Figure 2:
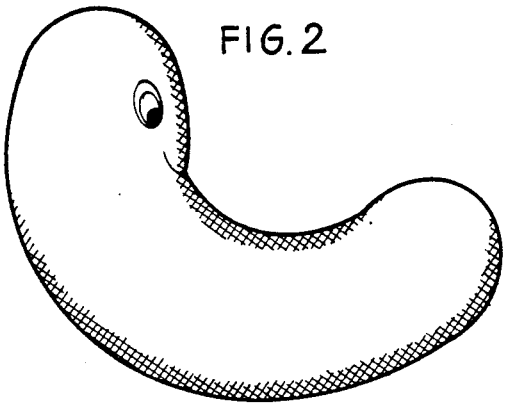
FIG. 2 is a side view.
Figure 3:
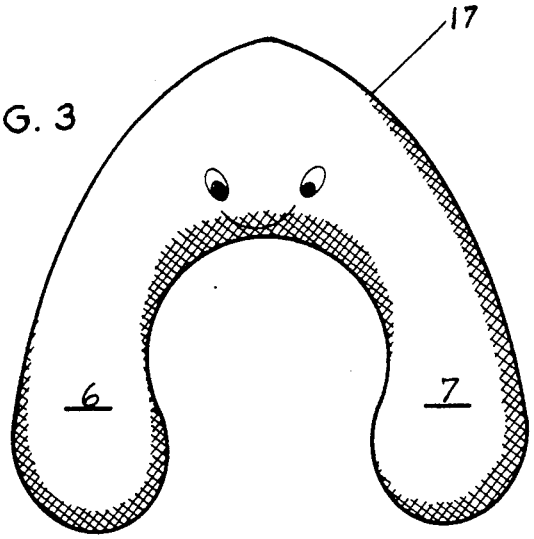
FIG. 3 is a top view.
Figure 4:
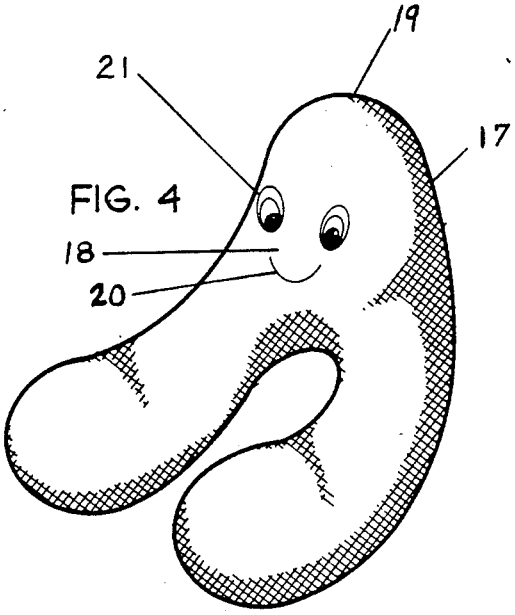
FIG. 4 is a perspective view.

With reference to the drawings, a stuffed toy 5 is illustrated that is constructed generally in the configuration of a wishbone of a bird. The toy 5 includes a pair of flexible elongated legs 6, 7 of generally uniform cross-section throughout their length and which have generally rounded ends. The legs 6, 7 are convexly curved along their lower surfaces such that the toy may be rocked back and forth on a flat surface.

An upwardly extending tapering rounded vertex portion 17 is formed at the intersection of the legs 6, 7 that includes an upwardly tapering rounded head 19 and rounded face portion 18. The face includes a mouth 20 and eyes 21 which may be painted, printed, silk screened or otherwise provided on the material of the toy.

The outer covering may be of various materials such as soft vinyl. It is constructed by sewing together several pieces and then stuffed with any of a variety of pillow stuffings, such as loose foam, kapok, or a molded element, which will allow the toy to be soft yet resilient enough to be distorted and yet return to its distinctive wishbone shape.

In use the toy may be set on a flat surface and rocked back and forth. The legs may be twisted pretzel-like into a simulated leg crossing position. It may be held in front of the child and hugged whereupon the legs 6, 7 of the wishbone appear to reach out and seemingly hug the child. When held in both hands, the toy gives an extremely pleasing tactile sensation. In the smaller sizes the toy is cute and cuddly. The larger sizes make excellent pillows as the legs tend to wrap around the child's neck and give warmth as well as support for relaxing comfort.

Having described my invention I claim:

1. A stuffed toy generally in the configuration of the wishbone of a bird, said toy including a pair of elongated stuffed legs of generally uniform cross-section with rounded ends and which are arcuately convexly curved along their length in a downward direction, said legs enabling said toy to be rocked on a flat surface and being capable of being twisted at least substantially into a cross-legged configuration and resiliently returning to the original wishbone configuration, and an upwardly tapering vertex head portion formed at the intersection of the legs including a rounded face portion having eyes and a mouth.

2. The stuffed toy of claim 1, wherein the face is painted on the toy.

3. The stuffed toy of claim 1, wherein the face comprises a silk screening.

* * * * *